US007808443B2

(12) United States Patent
Lindmark et al.

(10) Patent No.: US 7,808,443 B2
(45) Date of Patent: Oct. 5, 2010

(54) ANTENNA ARRANGEMENT WITH INTERLEAVED ANTENNA ELEMENTS

(75) Inventors: Björn Lindmark, Stockholm (SE); Jesper Uddin, Stockholm (SE)

(73) Assignee: Powerwave Technologies Sweden AB, Kista (SE)

( * ) Notice: Subject to any disclaimer, the term of this patent is extended or adjusted under 35 U.S.C. 154(b) by 209 days.

(21) Appl. No.: 11/989,080

(22) PCT Filed: Jul. 21, 2006

(86) PCT No.: PCT/SE2006/000904

§ 371 (c)(1),
(2), (4) Date: Jan. 18, 2008

(87) PCT Pub. No.: WO2007/011295

PCT Pub. Date: Jan. 25, 2007

(65) Prior Publication Data

US 2009/0135078 A1 May 28, 2009

(30) Foreign Application Priority Data

Jul. 22, 2005 (SE) ..... 0501723

(51) Int. Cl.
*H01Q 21/00* (2006.01)

(52) U.S. Cl. ..... 343/844; 343/815; 343/834; 343/853

(58) Field of Classification Search ..... 343/815, 343/834, 844, 853
See application file for complete search history.

(56) References Cited

U.S. PATENT DOCUMENTS

| | | | | |
|---|---|---|---|---|
| 5,923,296 | A * | 7/1999 | Sanzgiri et al. | 343/700 MS |
| 6,211,841 | B1 * | 4/2001 | Smith et al. | 343/813 |
| 6,295,028 | B1 * | 9/2001 | Jonsson et al. | 343/700 MS |
| 6,747,606 | B2 * | 6/2004 | Harel et al. | 343/808 |
| 6,816,124 | B2 * | 11/2004 | Tillery | 343/797 |
| 6,844,863 | B2 | 1/2005 | Judd et al. | |
| 6,933,905 | B2 * | 8/2005 | Ippolito | 343/797 |
| 7,068,222 | B2 * | 6/2006 | Koparan et al. | 343/700 MS |
| 2002/0140618 | A1 | 10/2002 | Plet et al. | |
| 2004/0145526 | A1 | 7/2004 | Puente Baliarda et al. | |

OTHER PUBLICATIONS

International Search Authority, Written Opinion for International Application No. PCT/SE2006/000904 dated Nov. 10, 2006, 4 pages.
International Search Authority, International Search Report for International Application No. PCT/SE2006/000904 dated Nov. 10, 2006, 4 pages.

* cited by examiner

*Primary Examiner*—Hoang V Nguyen
(74) *Attorney, Agent, or Firm*—OC Patent Law Group

(57) ABSTRACT

The present invention relates to an antenna arrangement connectable to a transceiver for transmitting and receiving RF signals in at least two separate frequency bands. The antenna arrangement has at least two sets of antenna elements arranged on a reflector, and the antenna elements are arranged in an interleaved configuration along a single column. The two separate frequency bands are substantially non-overlapping but relatively close to each other, and the distance between adjacent antenna elements in said column is substantially the same along the column.

19 Claims, 8 Drawing Sheets

ANTENNA ARRANGEMENT WITH INTERLEAVED ANTENNA ELEMENTS

This application is a 371 of PCT/SE2006/000904 dated Jul. 21, 2006.

TECHNICAL FIELD

The present invention relates to an antenna arrangement with interleaved antenna elements for multiple frequency band operation, especially for mobile communication systems, as defined in the preamble of claim 1. The invention also relates to an antenna system being adapted to communicate through a communication link with a base station.

BACKGROUND TO THE INVENTION

Present antenna arrays used for transmitting and receiving RF (Radio Frequency) signals in mobile communication systems are normally dedicated to a single frequency band or sometimes two or more frequency bands. Single frequency band antennas have been used for a long time and normally include a number of antenna elements arranged in a vertical row. A second row of antenna elements needs to be added beside the first row if the operator in a network wants to add another frequency band using single frequency band antennas. However, this requires enough space to implement and the arrangement may also be sensitive to interference between the RF signals in the different frequency bands.

These drawbacks have been partially resolved by prior art arrangements 10 which are schematically shown in FIGS. 1A and 1B.

In FIG. 1A two types of antenna elements 11, 12 have been arranged alternatively in a column. A first antenna element 11 is a dual band antenna element which operates in two different frequency bands $FB_1$ and $FB_2$, a second antenna element 12 is an antenna element which operates in only one frequency band $FB_1$. A drawback with this prior art embodiment is that the frequency bands $FB_1$ and $FB_2$ will couple to each other due to the closeness of the parts making up the antenna element 11.

Therefore, this kind of configuration is only suitable when the frequency bands have a big separation, for example if $FB_2$ is approximately twice the frequency as $FB_1$. If the frequency bands are too close, filters with high Q values, for example cavity filters which consume space and are relatively expensive and heavy, must be used very close to the antenna elements.

The prior art arrangement shown in FIG. 1B, as disclosed in U.S. Pat. No. 6,211,841 (Nortel), is formed by an array including first antenna elements, 11*a*, which are positioned in two parallel columns 13*a*, 14*a* and operate in a first, lower frequency band, and second antenna elements 12*a*, which are alternately located in two adjacent columns 13*a*, 15*a* and operate in a second, higher frequency band. One of these adjacent columns (13*a*) is the same as one of the columns accommodating the first antenna elements 11*a*, whereas the other column 15*a* is located between the columns 13*a*, 14*a*. By locating the antenna elements 11*a*, 12*a* in parallel, spaced apart columns side by side, it has been made possible to achieve the desired low coupling even between frequency bands which are relatively close to each other, namely up to a quotient of about ⅔.

In U.S. Pat. No. 6,844,863 B2 (Andrew Corporation), an arrangement with interleaved arrays of antenna elements is disclosed. Here, the various arrays deliberately couple to each other in a common frequency band.

Accordingly there is a need for a new antenna arrangement that will operate in two or more frequency bands with a reduced coupling between the frequency bands without using filters close to the elements or, if filters are needed, using filters with low Q values, such as micro strip or strip line filters, which are small in size and relatively cheap to implement.

SUMMARY OF THE INVENTION

An object with the present invention is to provide a multiple frequency-band antenna arrangement, and an antenna system, that will reduce the coupling between different frequency bands while at the same time minimizing the space needed compared to prior art antennas.

The object is achieved for a multiple frequency band antenna arrangement which is connectable to a transceiver for transmitting and receiving RF signals in at least two separate frequency regions. The antenna arrangement has at least two sets of antenna elements arranged on a reflector. A first set of antenna elements is arranged in a column and operates in a first frequency region, whereas a second set of antenna elements is likewise arranged in a column and operates in a second frequency region. According to the present invention, the first and second sets of antenna elements are interleaved along and positioned on a straight line so as to form a single column, said first and second frequency regions including first and second frequency bands, respectively, which are separate and substantially non-overlapping but relatively close to each other, and the distance between adjacent antenna elements in said column, operating in different frequency bands, are substantially the same along said column and is smaller than the wavelength $\lambda$ of the centre frequency of the highest one of said first and second frequency bands.

The object is also achieved by an antenna system being adapted to communicate through a communication link with a base station, wherein the antenna system comprises an antenna arrangement, and means for controlling the phase and amplitude of transmitting signals and receiving signals to/from antenna elements in said antenna arrangement.

An advantage with the present invention is that an isolation of more than 30 dB between the frequency bands can be obtained, without the use of cavity filters even if the frequency bands are close to each other.

Another advantage with the present invention is that it is easy to configure an antenna having a desired selection of frequency bands.

Still another advantage with the present invention is that the size of the antenna arrangement is maintained small compared to prior art arrangements.

Further objects and advantages are obvious by a skilled person from the detailed description below.

DETAILED DESCRIPTION OF THE PREFERRED EMBODIMENTS

Figure 1A:
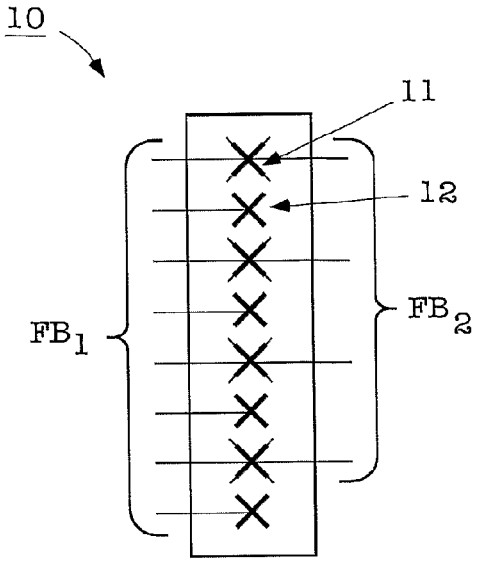
Fig. 1A (Prior Art)
FIG. 1A shows a schematic representation of a prior art dual band antenna arrangement.
Figure 1B:
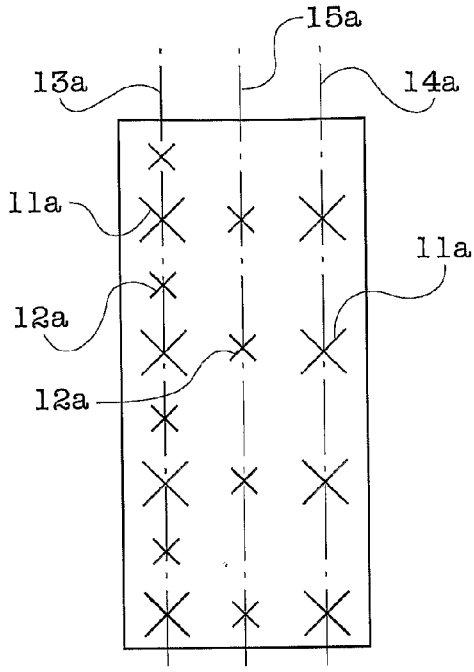
Fig. 1B (Prior Art)
FIG. 1B shows, schematically, another prior art dual band arrangement.

The prior art antenna arrangements shown in FIGS. 1A and 1B have been described above in the background to the invention.

Figure 2A:
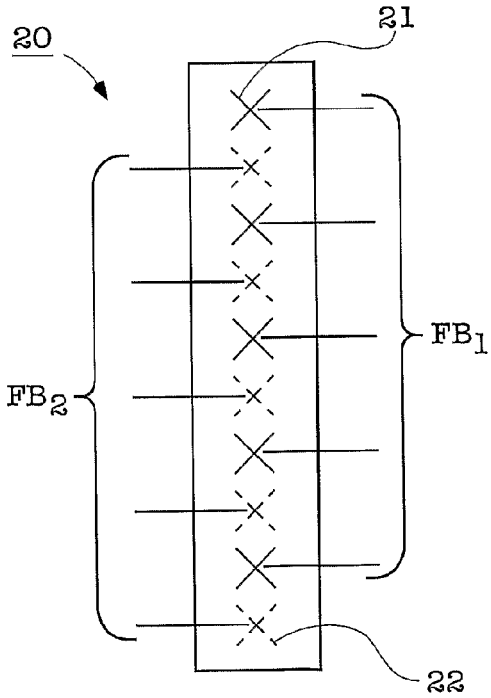
FIG. 2A shows a schematic representation of a dual band antenna arrangement according to the present invention.

FIG. 2A shows a schematic representation of a dual band antenna arrangement 20, according to the present invention, operating in two frequency regions including first and second frequency bands $FB_1$ and $FB_2$ which are separate and substantially non-overlapping but relatively close to each other. The antenna elements 21 (marked with continuous lines) operating in the lower frequency band $FB_1$ is of a first type and the antenna elements 22 (marked with dashed lines) operating in the higher frequency band $FB_2$ is of a second type.

Figure 2B:
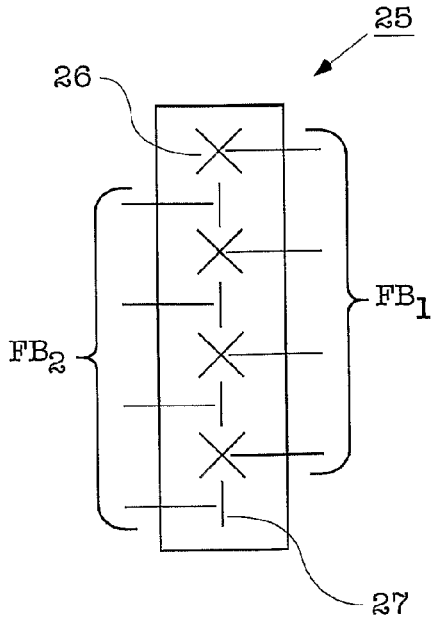
FIG. 2B shows a modified version of the arrangement of FIG. 2A.

The modified version of the dual band antenna arrangement 25, shown in FIG. 2B, is basically the same as the one shown in FIG. 2A, the only difference being that cross polarised antenna elements 26 are interleaved with linear y polarised antenna elements 27.

Figure 2C:
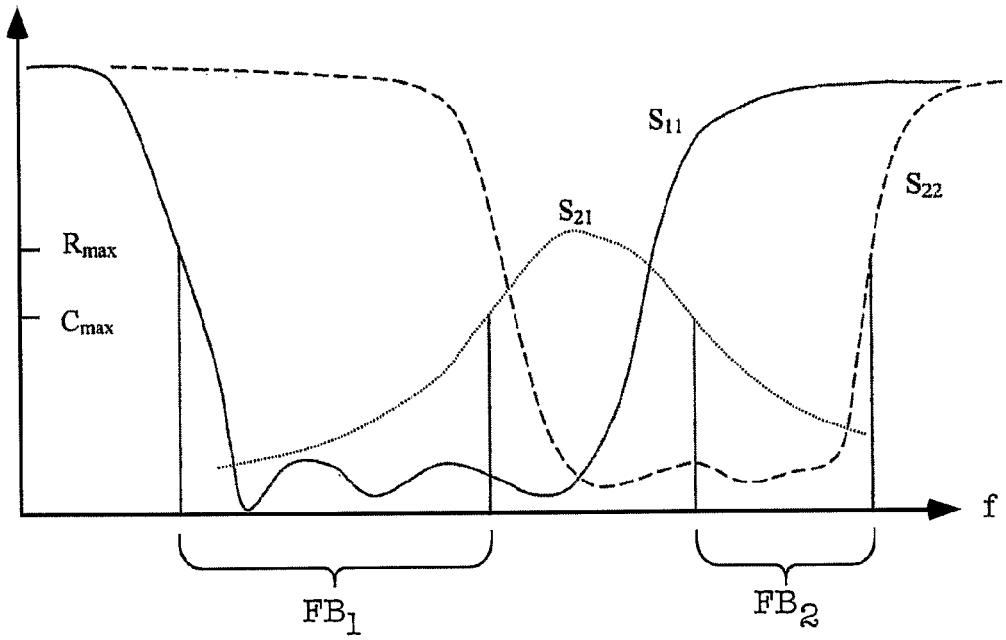
FIG. 2C illustrates the separation of the two frequency bands being used in the dual band antenna arrangement.

In FIG. 2C there is illustrated how the two frequency bands are "substantially non-overlapping". The input reflection coefficient for the antenna elements 21 (FIG. 2A) in the lower frequency range is represented by the S-parameter $S_{11}$, whereas the input reflection coefficient for the antenna elements 22 in the higher frequency range is represented by the C-parameter $S_{22}$. In practice, the reflection coefficient should be less than −15 dB ($R_{max}$). Moreover, the cross-coupling coefficient between the two frequency ranges should also be low, say less than −20 dB ($C_{max}$). By the use of these criteria, we can define the operative frequency bands $FB_1$ and $FB_2$, as shown schematically in FIG. 2C. Thus, although the respective frequency does in fact overlap partially, the selected frequency bands $FB_1$ and $FB_2$ are separate and distinct from each other.

The first and second frequency bands should have centre frequencies being related as follows:

$$2/3 < f1/f2 < 3/2,\ f1 \neq f2$$

and typical examples of possible centre frequencies are f1=850 MHz, f2=900 MHz;

f1=1800 MHz, f2=2000 MHz;

f1=1900 MHz, f2=2100 MHz;

f1=2000 MHz, f2=2500 MHz.

The antenna elements could be patches, dipoles, cross polarized antenna elements, dielectric resonator antennas (DRA) or any other type of antenna elements available to the skilled person. The essential feature of the invention is that each antenna element operates in only one frequency band and that they are arranged on a reflector in an interleaved configuration along a straight line, in a single column, as illustrated in FIG. 2.

Figure 3:
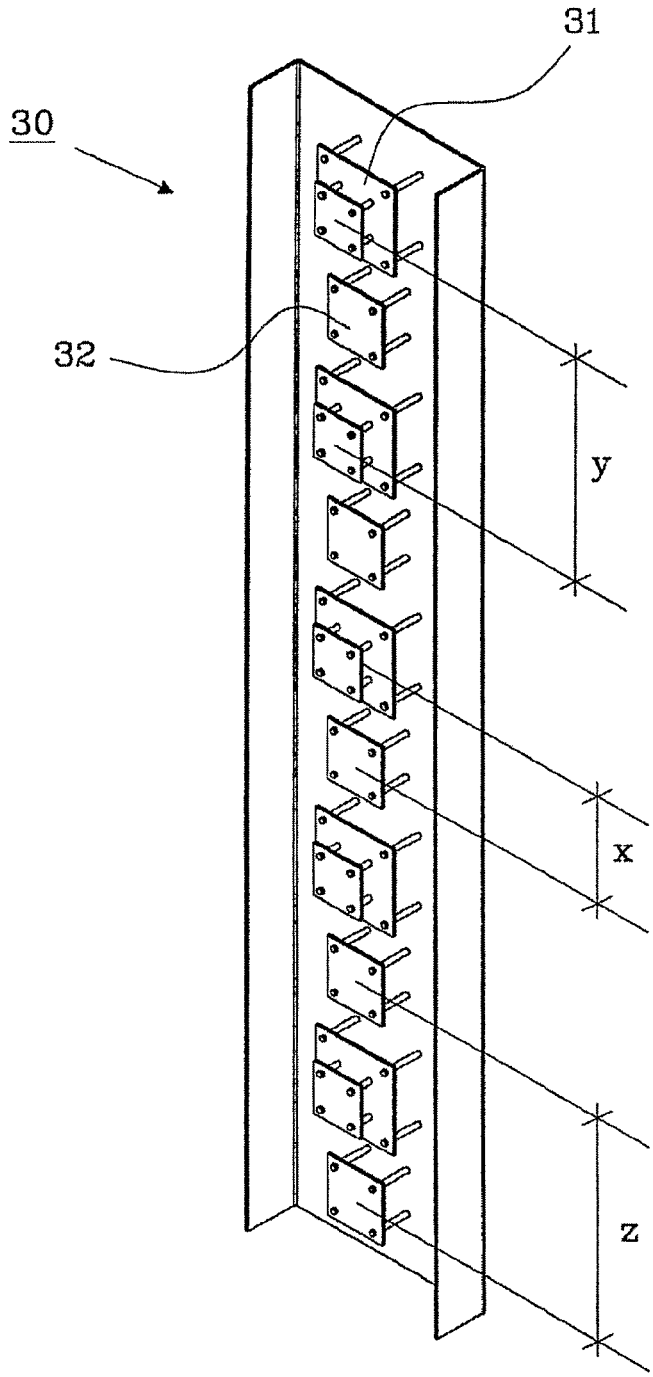
FIG. 3 shows a perspective view of a first embodiment of a dual band antenna arrangement according to the present invention.
Figure 4:
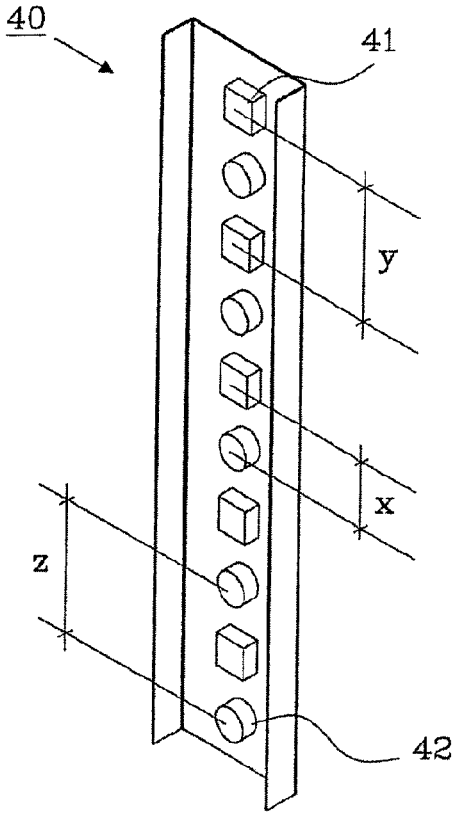
FIG. 4 shows a perspective view of a second embodiment of a dual band antenna arrangement.
Figure 5:
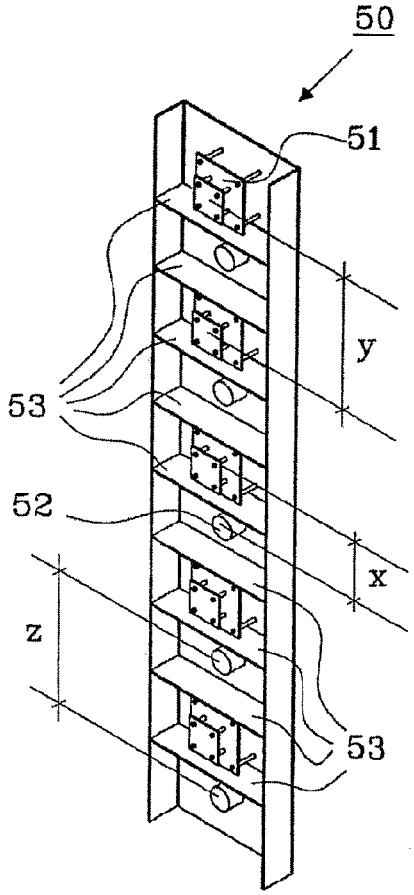
FIG. 5 shows a perspective view of a third embodiment of a dual band antenna arrangement.

FIGS. 3, 4 and 5 show different embodiments of the schematic representation in FIG. 2.

FIG. 3 shows a dual band antenna arrangement 30 having a first type of antenna elements 31 implemented as a double patch antenna element transmitting and receiving within a lower frequency band $FB_1$. A second type of antenna element 32 is implemented as a patch antenna element transmitting and receiving within a higher frequency band $FB_2$. An example of a lower frequency band could be 1710-2170 MHz and an example of a higher frequency band could be 2.5-2.7 GHz. Both types of antenna elements are known to those skilled in the art.

An intermediate distance "x", between the centres of two adjacent antenna elements, is substantially the same for all antenna elements in the array, which for the frequency bands exemplified above is in the range 0.3-0.7λ (λ=the wavelength of the centre frequency of the highest one of the two frequency bands) or 28-54 mm. A first distance "y", between antenna elements 31 that operate within the same frequency band, namely the lower frequency band, is in the range of a distance that corresponds to 0.5-0.9 lambda (λ) of the centre frequency of that (lower) frequency band. Likewise, a second distance "z", between antenna elements 32 that operate within the higher frequency band, is in the range of a distance that corresponds to 0.5-0.9 lambda (λ) of the centre frequency of that (higher) frequency band. The distance y may be different from the distance z, but since this will give rise to un-desired effects, it is preferred that the distance y is equal to z. As an example y and z are selected to be approx. 100 mm each.

The embodiment described in connection with FIG. 3 contains types of antenna elements that are rather large and there may be a problem concerning the appearance of grating lobes that will occur when two antenna elements are placed too far from each other.

This effect has been considered in the embodiments illustrated in FIGS. 4 and 5.

In FIG. 4, a perspective view of a second embodiment of a dual band antenna array 40 is shown. The dual band antenna array 40 contains two types of antenna elements, a first type 41 for the lower frequency band and a second type 42 for the higher frequency band. As an example, the first type of antenna elements 41 only receives RF signals within a range of 1920-1980 MHz and the second type of antenna elements 42 only transmits RF signals within a range of 2110-2170 MHz, which leaves a suppressed frequency band of 130 MHz therebetween. Thereby a traditional antenna for the UMTS band is replaced by a dual band antenna with separate antenna elements for the $R_X$ band and $T_x$ band, respectively, so that simplified $T_x$ and $R_x$ radio chains can be realized.

Both types 41 and 42 of antenna elements are made of a DRA (Dielectric Resonator Antenna) which are considerable smaller than conventional patch antennas. The drawback with the DRA is that they might have a narrow bandwidth compared to other types of antenna elements, but if used only for reception or transmission they will operate in a desired way. The size of the DRA compared to patches, as described in connection with FIG. 3, will minimize the appearance of grating lobes since the antenna elements can be placed closer together compared to the antenna elements described in connection with FIG. 2.

In FIG. 5, a perspective view of a third embodiment of a dual band antenna array 50 is shown. The dual band antenna array 50 contains two types of antenna elements, a first type 51 for the lower frequency band and a second type 52 for the higher frequency band. As an example, the first type of antenna elements 51 transmits and receives RF signals within a range of 1710-2170 MHz, which is similar to the antenna element 31 described in connection with FIG. 3. The second type of antenna elements 52 transmits and receives RF signals within a range of 2.5-2.7 GHz, which is the same frequency band as antenna element 32 (FIG. 3) operated within.

A difference between the previously described antenna element 32 and the antenna element 52 is the type of antenna element being used. In the third embodiment described in connection with FIG. 5, a DRA is used as the second type of antenna element. Although the DRA might have a narrow bandwidth, the second antenna element will be sufficient to ensure proper operation. To reduce the coupling between adjacent antennas elements (and thereby lower the requirements/need of filters), a shielding wall 53 is provided between each antenna element 51, 52, with the distances (x, y and z) maintained as described in connection with FIG. 3.

Dielectric Resonator Antennas (DRA) are preferably used for the higher frequency band due to the narrow bandwidth.

Figure 6:
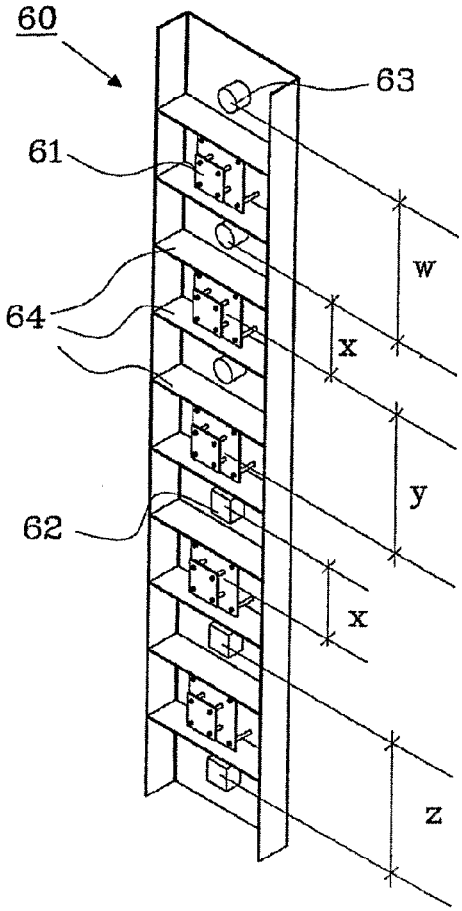
FIG. 6 shows a perspective view of a first embodiment of a multi band antenna arrangement.
Figure 7:
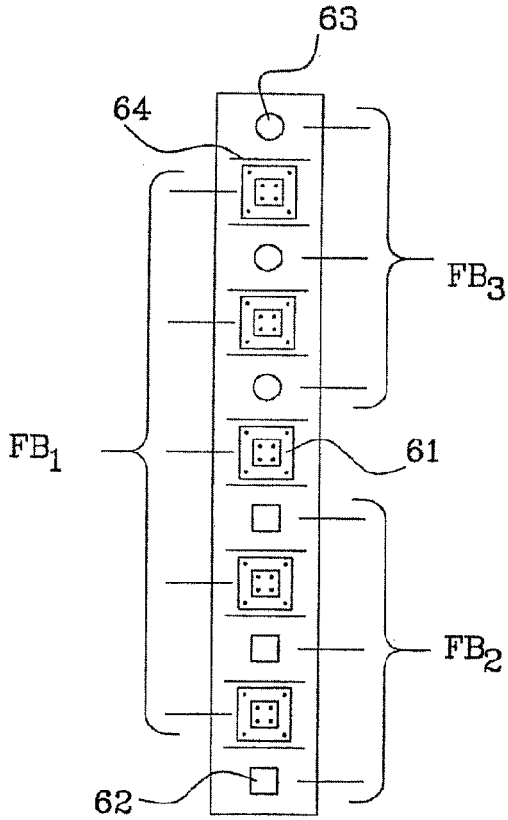
FIG. 7 shows a schematic representation of the multi band antenna arrangement in FIG. 6.

FIGS. 6 and 7 show an embodiment of a multi band antenna array 60 of the present invention including three different frequency bands. This embodiment includes three types of antenna elements, a first type 61 for a lower frequency band $FB_1$ a second type 62 for a middle frequency band $FB_2$ and a third type 63 for a higher (or even lower) frequency band $FB_3$. As examples, the following combinations of centre frequencies f1, f2, f3 are possible:

f1=850 MHz, f2=900 MHz, f3=1800 MHz;

f1=850 MHz, f2=900 MHz, f3=1900 MHz;

f1=850 MHz, f2=900 MHz, f3=2000 MHz;

f1=1800 MHz, f2=2000 MHz, f3=2500 MHz;

f1=1800 MHz, f2=2000 MHz, f3=2500 MHz;

f1=2000 MHz, f2=2500 MHz, f3=900 MHz.

There are five patch antenna elements 61 with three square-shaped DRA 62 interleaved with the three of the lowest patch antenna elements 61, and three circular-shaped DRA 63 interleaved with the three of the highest patch antenna elements 61. This results in a single column with eleven interleaved antenna elements operating at three separate frequency bands. The presence of DRA makes it possible to include shielding walls 64 between each antenna element in the column to minimize the grating lobes.

The distances between adjacent antenna elements are substantially the same as discussed in connection with FIG. 3. An intermediate distance "x", between the centres of two adjacent antenna elements, is substantially the same for all antenna elements in the column. A first distance "y", between two antenna elements 61 that operate within the lower frequency band, is preferably a distance that corresponds to 0.5-0.9 lambda of the centre frequency of the lower frequency band, i.e. 1940 MHz in this example. A second distance "z", between two antenna elements 62 that operate within the middle frequency band, is preferably a distance that corresponds to 0.5-0.9 lambda of the centre frequency, i.e. 2.35 GHz in this example, of the middle frequency band. A third distance "w", between two antenna elements 63 that operate within the higher frequency band, is preferably a distance that corresponds to 0.5-0.9 lambda of the centre frequency, i.e. 2.6 GHz in this example, of the higher frequency band.

The distances y, z and w may be differ somewhat from each other, but since this will give rise to undesired effects, it is preferred that the distances y, z and w are equal to each other.

Figure 8:
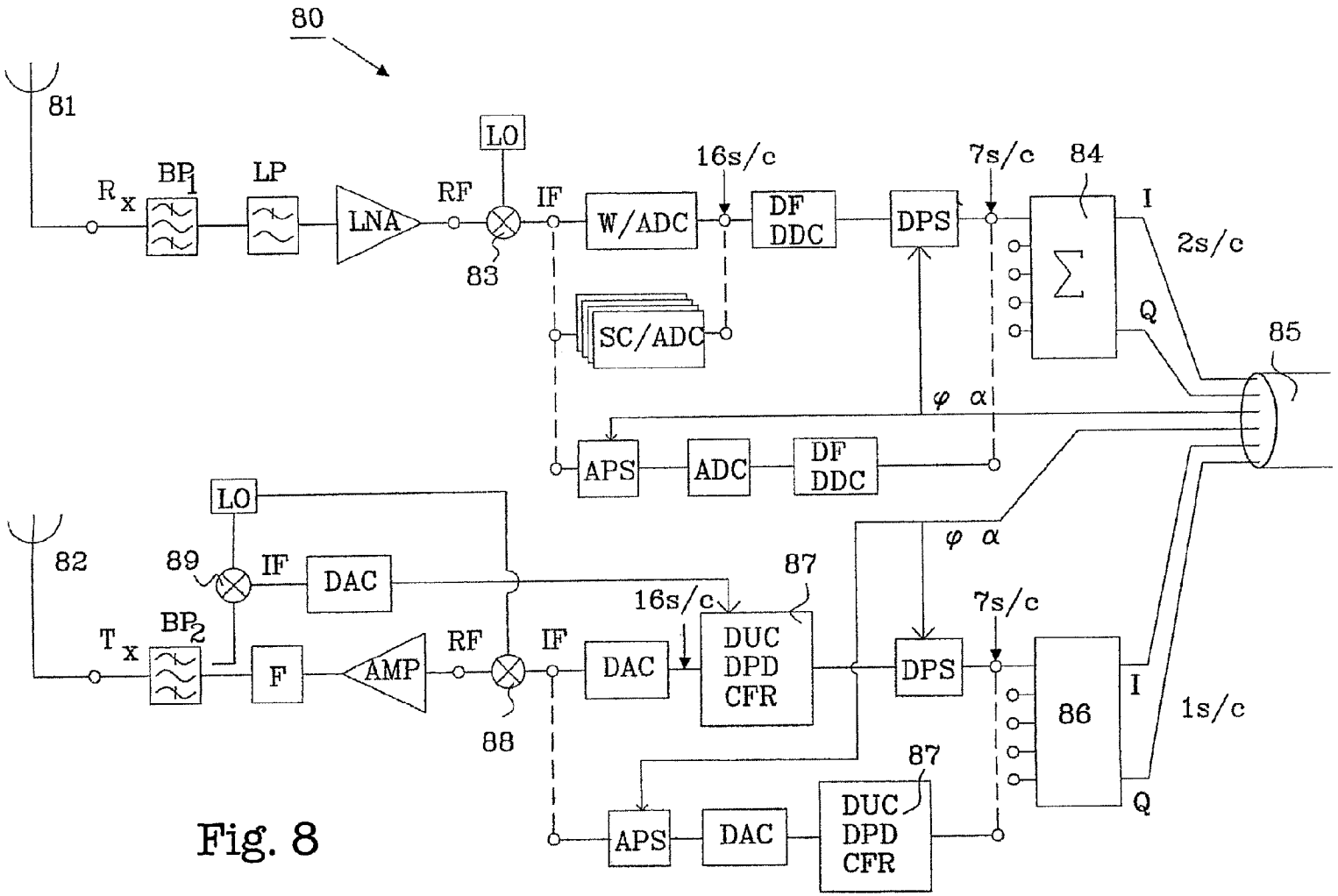
FIG. 8 shows a block diagram illustrating the signal path in an antenna system, including an antenna arrangement according to the invention.

FIG. 8 shows a block diagram illustrating the signal path in an antenna system 80 according to the present invention. The signal path can be divided into a transmission path $T_x$ and a reception path $R_x$ that are connected to a separate antenna element 81 and 82 for each path as illustrated in the drawing or a common antenna element (not shown).

The reception path $R_x$ comprises a band pass filter $BP_1$ to filter out the desired Radio frequency (RF) band connected in series with an optional low pass filter LP to remove spurious resonances before the filtered RF signal is fed into a Low Noise Amplifier LNA. The amplified RF signal is frequency shifted to an IF (Intermediate Frequency) signal using a Local Oscillator LO and a mixer 83. The IF signal is thereafter converted to a digital signal using an arrangement including an Analogue-to-Digital Converter (ADC).

There are three different arrangements shown in FIG. 8. The first option includes a Wideband A/D Converter W/ADC that converts the complete RF band into a digital stream of 16 s/c (samples/chip). The second option includes several single carrier A/D Converter SC/ADC that together converts the complete RF band into a digital stream of 16 s/c.

The 16 s/c digital signal in the first and second option is thereafter fed into a digital filter DF and a Digital Down Converter DDC. The DDC converts the 16 s/c signal to a 7 s/c signal which is fed to a digital phase shifter DPS which receives control signals, preferably in digital form. The control signals are received from a connected base station (not shown) through a communication line, such as a fibre 85. DPS controls the phase $\phi$ and amplitude $\alpha$ of the digitized IF signal. The signal from the DPS is fed into a summation module 84 together with signals from other optional antenna elements.

The third option for converting the IF signal to a digitized signal include an analogue phase shifter APS, to which control signals, preferably in analogue form, are fed that are received from a connected base station (not shown) through a communication line, such as a fibre 85. APS controls the phase $\phi$ and amplitude a of the IF signal which is digitized using a following Analogue-to-Digital Converter ADC which converts the signal into a digital stream of 16 s/c. The 16 s/c digital signal in the third option is thereafter fed into a digital filter DF and a Digital Down Converter DDC. The DDC converts the 16 s/c signal to a 7 s/c signal and is fed into the summation module 84 together with signals from other optional antenna elements.

Digital I and Q signals of 2 s/c are thereafter sent to the base station through the fibre 85. Communication through the fibre may use CPRI-standard communication protocols.

The base station also supplies a digital I and Q signal of 1 s/c for transmission to a splitter 86. The signal can be controlled in a digital or an analogue way, both being described in connection with FIG. 8.

In a digital option the signal from the splitter 86 is fed to a Digital Phase Shifter DPS, which is supplied with digital control signals for controlling the phase $\phi$ and amplitude a of the transmission signal from the base station through the fibre 85. The signal is then fed to a device 87 for Digital Up Conversion DUC, a Digital Predistortion PDP and Crest Factor Reduction CFR is thereafter connected to the digital transmission signal. The DUC converts the signal to 16 s/c from 7 s/c. The DPD is used to obtain a linear signal after the signal is amplified and CFR is used to limit the peak in the signal to optimize the performance of the amplifier AMP. The digital signal is thereafter processed in a Digital/Analogue Converter DAC to an IF transmission signal.

In an analogue option the signal is fed to a device 87 for Digital Up Convertion DUC, a Digital Predistortion PDP and Crest Factor Reduction CFR is thereafter connected to the digital transmission signal. The digital signal is thereafter processed in a Digital/Analogue Converter DAC to an IF transmission signal, and is thereafter fed to an Analogue Phase Shifter APS, which is supplied with analogue control signals for controlling the phase $\phi$ and amplitude a of the transmission signal from the base station through the fibre 85.

The signal is then frequency shifted to a RF transmission signal using a local oscillator LO and a mixer 88. The RF transmission signal is amplified in an amplifier AMP with a following optional filter F. A band pass filter $BF_2$ completes the transmission path, where the desired radio frequency band is selected before transmission via the antenna element 82. The RF signal is sensed before the band pass filter $BF_2$ and frequency shifted to an IF feedback signal using a local oscillator LO and a mixer 89. The IF feedback signal is converted to a digital signal, using a Digital-to-Analogue Converter DAC, and fed into the DPD in the device 87. The same local oscillator LO is used for the transmission path.

In the example, different antenna elements 81, 82 are used for transmission and reception of the signals, but naturally a common antenna element may be used for both transmission and reception.

Figure 9:
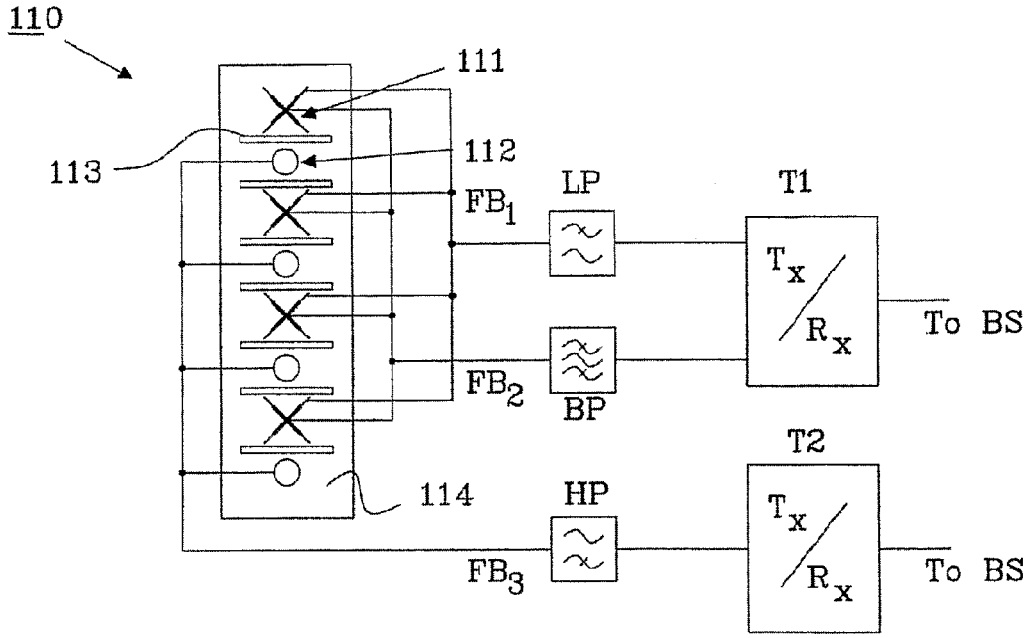
FIG. 9 shows schematic representation of a second embodiment of a multi band antenna array including additional filters.

FIG. 9 shows a schematic representation of a second embodiment of a multiband antenna array 110 including additional filters LP, BP, and HP to provide a better isolation between the operating frequency bands $FB_1$, $FB_2$, and $FB_3$ for the antenna arrangement.

The antenna arrangement 110 comprises two types of antenna elements, where a first antenna element 111 is a dual band antenna element receiving RF signals in a first frequency band $FB_1$, and transmitting RF signals in a second frequency band $FB_2$. The RF signals received in the first frequency band $FB_1$ is fed to a low pass filter LP, or a band pass filter for low frequencies, and thereafter to a first transceiver circuit T1. Transmitting RF signals from the first transceiver circuit T1 are fed to a band pass filter BP and thereafter to the dual band antenna element 111.

The second type of antenna element 112 is operating within a third, higher frequency band $FB_3$, i.e. both receiving and transmitting RF signals within $FB_3$. RF signals to/from the antenna element 112 is fed through a high pass filter HP, or a band pass filter for high frequencies, to/from a second transceiver circuit T2. Transceiver circuits T1 and T2 are connected to a base station BS (not shown).

Suppression means in the form of metallic strips 113 are arranged between each antenna element 111, 112, to shield the antenna elements from each other. Each metallic strip is fastened to the reflector 114 in an isolating way, e.g. using a dielectric material disposed therebetween. The filters will provide an increased isolation of more than 30 dB, whereas the construction in itself may only give an isolation of 15-20 dB.

Only one filter is provided for all antenna elements operating within a frequency band in this embodiment, and in FIG. 14 another embodiment is illustrated wherein a separate filter is used for each antenna element.

Figure 10:
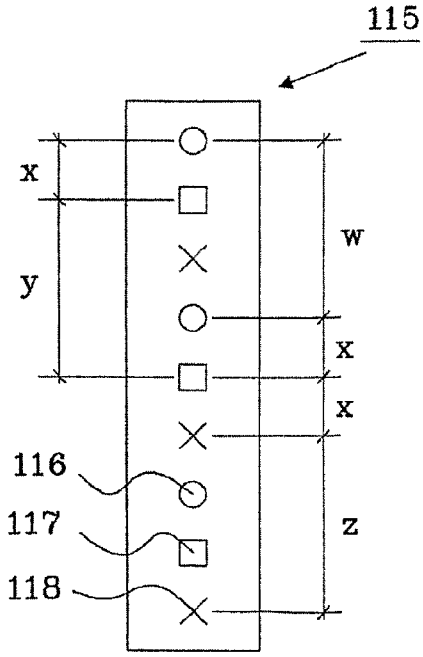
FIG. 10 shows a schematic representation of a third embodiment of a multi band antenna array.

FIG. 10 shows a schematic representation of a third embodiment of a multi band antenna arrangement 115, comprising three types of DRA antenna elements 116, 117, and 118. These elements are interleaved in such a way that two antenna elements of different type are arranged between two antenna elements of the same type. The distances y, z, and w are preferably the same as described in connection with FIG. 6 and the distances x between adjacent antenna element 116, 117 and 118 is preferably equal to each other.

Figure 11:
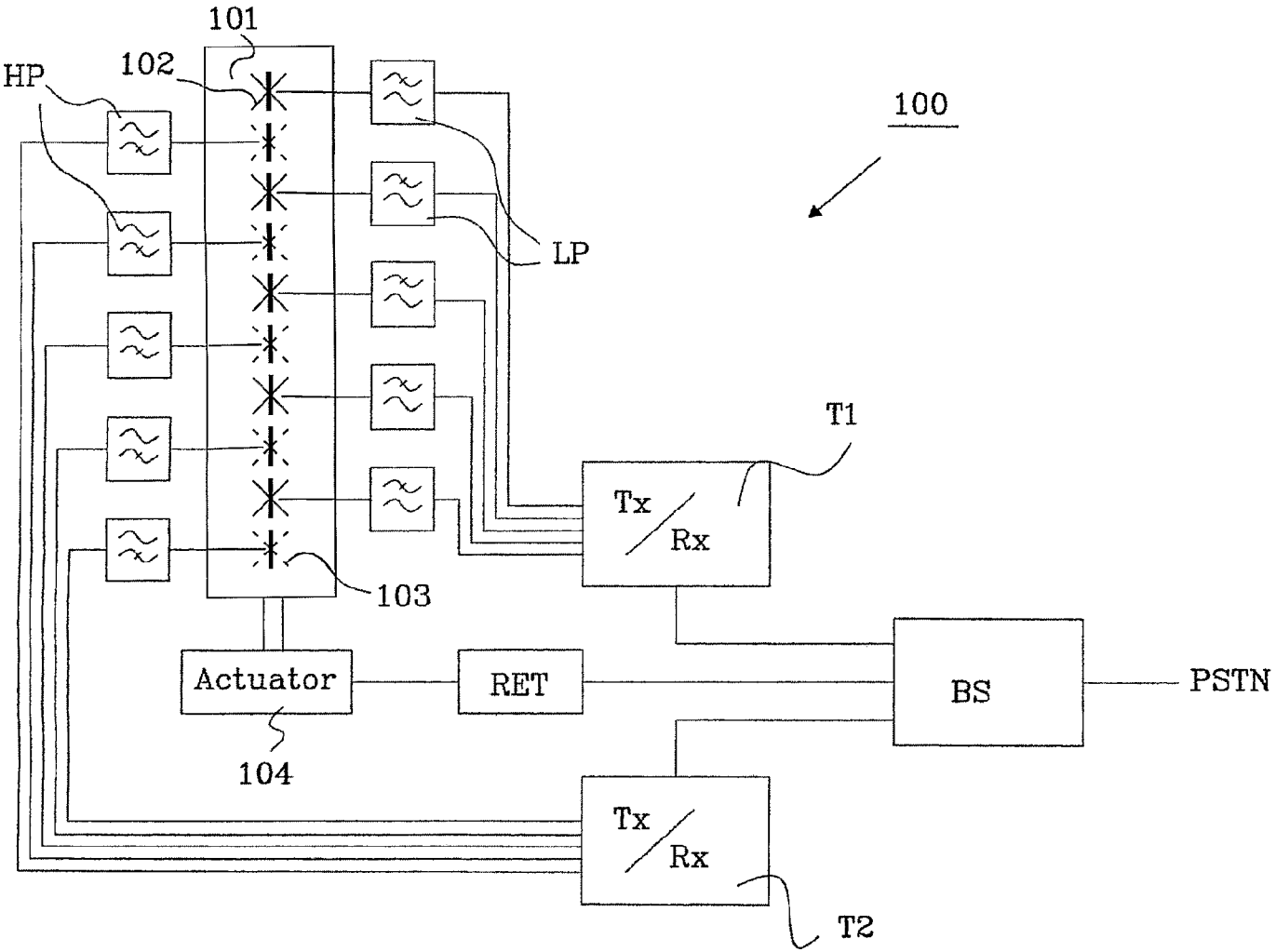
FIG. 11 shows an antenna system, including a multi band antenna according to the invention.

A suitable means to further increase the isolation between the frequency bands in a multi-band antenna is illustrated in FIG. 11. The figure shows a communication system 100 having a dual band antenna arrangement 101, such as any of those illustrated in connection with FIGS. 2A, 2B, 3, 4, and 5, with a low pass filter, (or band pass filter), LP between each antenna element 102 operating in the low frequency band and the transceiver circuitry T1 for the low frequency band, and a high pass filter, (or band pass filter), HP between each antenna element 103 operating in the high frequency band and the transceiver circuitry T2 for the high frequency band. Each transceiver circuitry T1, T2 is illustrated in connection with FIG. 8 and is connected to a base station BS, which is connected to the PSTN as is well-known to a person skilled in the art.

The antenna system 100 also includes a device for Remote Electrical Tilt RET, which is controlled by the base station BS. RET controls an actuator 104 that will change the electrical tilt of the lobes from the antenna 101, as is well-known to those skilled in the art.

If the antenna arrangement 101 includes an antenna arrangement with more than two frequency bands, such as the embodiment shown in FIGS. 6, 7, and 13, then each antenna element operating at an intermediate frequency band is provided with a band pass filter to increase the isolation to the lower and higher frequency bands. The filters will provide an increased isolation of more than 30 dB, whereas the construction in it self may only give an isolation of 15-20 dB.

The feeding of the antenna elements may include probe feeding, aperture feeding for all types of contemplated antenna elements, such as Patch antennas, DRA, Dipole antennas, cross polarized antennas.

The invention claimed is:

1. An antenna arrangement connectable to a transceiver for transmitting and receiving RF signals in at least two separate frequency bands, said antenna arrangement having at least two sets of antenna elements in an interleaved arrangement on a reflector, wherein a first set of antenna elements is arranged in a column and operates in a first frequency region, whereas a second set of antenna elements is likewise arranged in a column and operates in a second frequency region, wherein said first and second sets of antenna elements are interleaved along and positioned in a non-overlapping configuration on a straight line so as to form a single column, said first and second frequency regions include first and second frequency bands, respectively, which are separate and substantially non-overlapping but relatively close to each other, and the distance (x) between adjacent antenna elements in said column, operating in different frequency bands, is substantially the same along said column and is smaller than the wavelength $\lambda$ of the centre frequency of the highest one of said first and second frequency bands.

2. The antenna arrangement defined in claim 1, wherein the centre frequencies f1 and f2 of said first and second frequency bands are related as follows:

$\frac{2}{3}<f1/f2<3/2$, and f1 is different from f2.

3. The antenna arrangement defined in claim 1, wherein said distance (x) between adjacent antenna elements in said single column is in the range of 0.3-0.7$\lambda$.

4. The antenna arrangement defined in claim 3, wherein said distance (x) between adjacent antenna elements in said single column is in the range 28-54 mm.

5. The antenna arrangement according to claim 1, wherein said first and second centre frequencies have approximate values in one of the following combinations:

f1=850 MHz, f2=900 MHz;

f1=1800 MHz, f2=2000 MHz;

f1=1900 MHz, f2=2100 MHz;

f1=2000 MHz, f2=2500 MHz.

6. The antenna arrangement according to claim 1, wherein said single column of antenna elements includes also a third set of antenna elements operating in a third frequency region including a frequency band which is separate and non-overlapping relative to said first and second frequency bands, the centre frequency of said third frequency band being higher or lower than the centre frequencies of said first and second frequency bands.

7. The antenna arrangement according to claim 6, wherein said first, second and third sets of antenna elements operate in separate frequency bands, with centre frequencies f1,f2,f3 having approximate values in one of the following combinations:

f1=850 MHz, f2=900 MHz, f3=1800 MHz;

f1=850 MHz, f2=900 MHz, f3=1900 MHz;

f1-850 MHz, f2=900 MHz, f3=2000 MHz;

f1=1800 MHz, f2=2000 MHz, f3=2500 MHz;

f1=1800 MHz, f2=2000 MHz, f3=2500 MHz;

f1=2000 MHz, f2=2500 MHz, f3=900 MHz.

8. The antenna arrangement according to claim 6, wherein the antenna elements of said third set are located at the same positions as at least some of the antenna elements of said first and second sets.

9. The antenna arrangement according to claim 6, wherein the antenna elements of said third set are located at positions being different to those of the antenna elements of said first and second sets, the third set of antenna elements being also interleaved between antenna elements of said first and second sets.

10. The antenna arrangement according to claim 1, wherein at least some of the antenna elements are dual polarised with mutually crossing polarisations.

11. The antenna arrangement according to claim 1, wherein at least some of the antenna elements are linearly polarised.

12. The antenna arrangement according to claim 1, wherein said first and second sets of antenna elements are used for transmitting RF signals (Tx) and receiving RF signals (Rx), respectively.

13. The antenna arrangement according to claim 1, wherein a distance (y, z, w) between two antenna elements, arranged in said single column and operating in the same frequency band, is in the range of a distance that corresponds to 0.5-0.9 lambda (λ) of the centre frequency of the respective band.

14. The antenna arrangement according to claim 1, wherein at least one of said at least two sets of antenna elements is one of the following kinds of antenna elements:

a dielectric resonator antenna (DRA) element a dipole antenna element or, a patch antenna element.

15. The antenna arrangement according to claim 1, wherein coupling between the separate frequency bands (FBi, $FB_2$, FB3) is suppressed by providing suppression means (53; 64; 93, 94; 113) between adjacent antenna elements.

16. The antenna arrangement according to claim 15, wherein said suppression means is a parasitic element, such as a metallic strip (113).

17. The antenna arrangement according to claim 15, wherein said suppression means is a shielding wall (53; 64; 93, 94).

18. The antenna arrangement according to claim 1, wherein a filter (LP, BP, HP) having a low Q-value is connected between each antenna element (102,103; 111,112) and a transceiver circuit (TI, T2), said filter being adapted to further isolate each frequency band (FBi, $FB_2$, $FB_3$) from each other.

19. An antenna system (80) being adapted to communicate through a communication link (85) with a base station (BS), including an antenna arrangement according to claim 1, and means for controlling the phase and amplitude (APS; DPS) of transmitting signals and receiving signals to/from antenna elements (81, 82) in said antenna arrangement.

* * * * *